US010251441B2

(12) United States Patent
Benetti

(10) Patent No.: US 10,251,441 B2
(45) Date of Patent: Apr. 9, 2019

(54) RIDING BOOTS

(71) Applicant: ACAVALLO S.R.L., Lonato del Garda, Brescia (IT)

(72) Inventor: Mauro Benetti, Brescia (IT)

(73) Assignee: ACAVALLO S.R.L., Lonato del Garda (Brescia) (IT)

( * ) Notice: Subject to any disclaimer, the term of this patent is extended or adjusted under 35 U.S.C. 154(b) by 226 days.

(21) Appl. No.: 14/889,893

(22) PCT Filed: May 6, 2014

(86) PCT No.: PCT/IB2014/061243
§ 371 (c)(1),
(2) Date: Nov. 9, 2015

(87) PCT Pub. No.: WO2014/181255
PCT Pub. Date: Nov. 13, 2014

(65) Prior Publication Data

US 2016/0120259 A1 May 5, 2016

(30) Foreign Application Priority Data

May 10, 2013 (IT) ..... BS2013A0065

(51) Int. Cl.

| | |
|---|---|
| ***A43C 17/00*** | (2006.01) |
| ***A43B 5/00*** | (2006.01) |
| ***A43B 23/08*** | (2006.01) |
| ***A43C 17/04*** | (2006.01) |

(52) U.S. Cl.
CPC ..... *A43B 5/006* (2013.01); *A43B 23/088* (2013.01); *A43C 17/04* (2013.01)

(58) Field of Classification Search
CPC ..... A43C 17/00; A43C 17/02; A43C 17/04; A43C 17/06; A43C 5/006; A43C 23/088
See application file for complete search history.

(56) References Cited

U.S. PATENT DOCUMENTS

| | | | | |
|---|---|---|---|---|
| 39,106 | A | 6/1863 | Langholz | |
| 2,098,017 | A * | 11/1937 | Seyfarth | A43C 17/04 54/83.1 |
| 2,290,445 | A * | 7/1942 | Oleyar | A43C 17/02 36/1 |
| 2,907,161 | A * | 10/1959 | Chandler | A43C 17/02 54/83.1 |
| 8,312,699 | B2 * | 11/2012 | Cook | A43C 17/02 54/83.1 |
| 2003/0226287 | A1 * | 12/2003 | Borne | A43B 3/0031 36/131 |
| 2007/0033910 | A1 | 2/2007 | Harrison et al. | |
| 2009/0064641 | A1 * | 3/2009 | Wetherell | A43C 17/00 54/83.1 |
| 2009/0083997 | A1 | 4/2009 | Edwards et al. | |

* cited by examiner

*Primary Examiner* — Jila M Mohandesi
(74) *Attorney, Agent, or Firm* — Robert E. Alderson, Jr.

(57) ABSTRACT

A boot for riding which includes a spur and a spur-holder seat associated to the boot are provided. The spur can include a portion slidingly inserted in the spur-holder seat. Such boots are configured to allow easy adjustment of the position of the spur which allows the comfortable and safe positioning for horseback riding.

8 Claims, 9 Drawing Sheets

RIDING BOOTS

CROSS-REFERENCE TO RELATED APPLICATIONS

This application is a National Phase Application of PCT International Application No. PCT/IB2014/061243, International Filing Date, May 6, 2014, claiming priority to Italian Patent Application No. BS2013A000065, filed May 10, 2013, each of which is hereby incorporated by reference in its entirety.

FIELD OF THE INVENTION

The present invention relates to a horse-riding boot and in particular to a boot with a spur.

BACKGROUND OF THE INVENTION

As is known, spurs are usually connected to the boots by means of laces or other devices which do not however permit adjustment of the position of the spur. In addition, traditional spurs have some drawbacks. For example, they may damage the upper and the zip of the boot and may cause discomfort to the instep when the lace is tightened. In addition, the arms of the spur which extend along the sides of the boot can cause tripping during normal walking and may unintentionally touch the horse's ribcage.

SUMMARY OF THE INVENTION

The purpose of the present invention is to propose a boot for horse-riding able to overcome the aforesaid drawbacks.

Said purpose is achieved by riding boots as described and claimed herein.

Characteristics and advantages of riding boots according to the invention will be evident from the description given below of representative embodiments made by way of a non-limiting examples with reference to the attached drawings.

DETAILED DESCRIPTION

Figure 1:
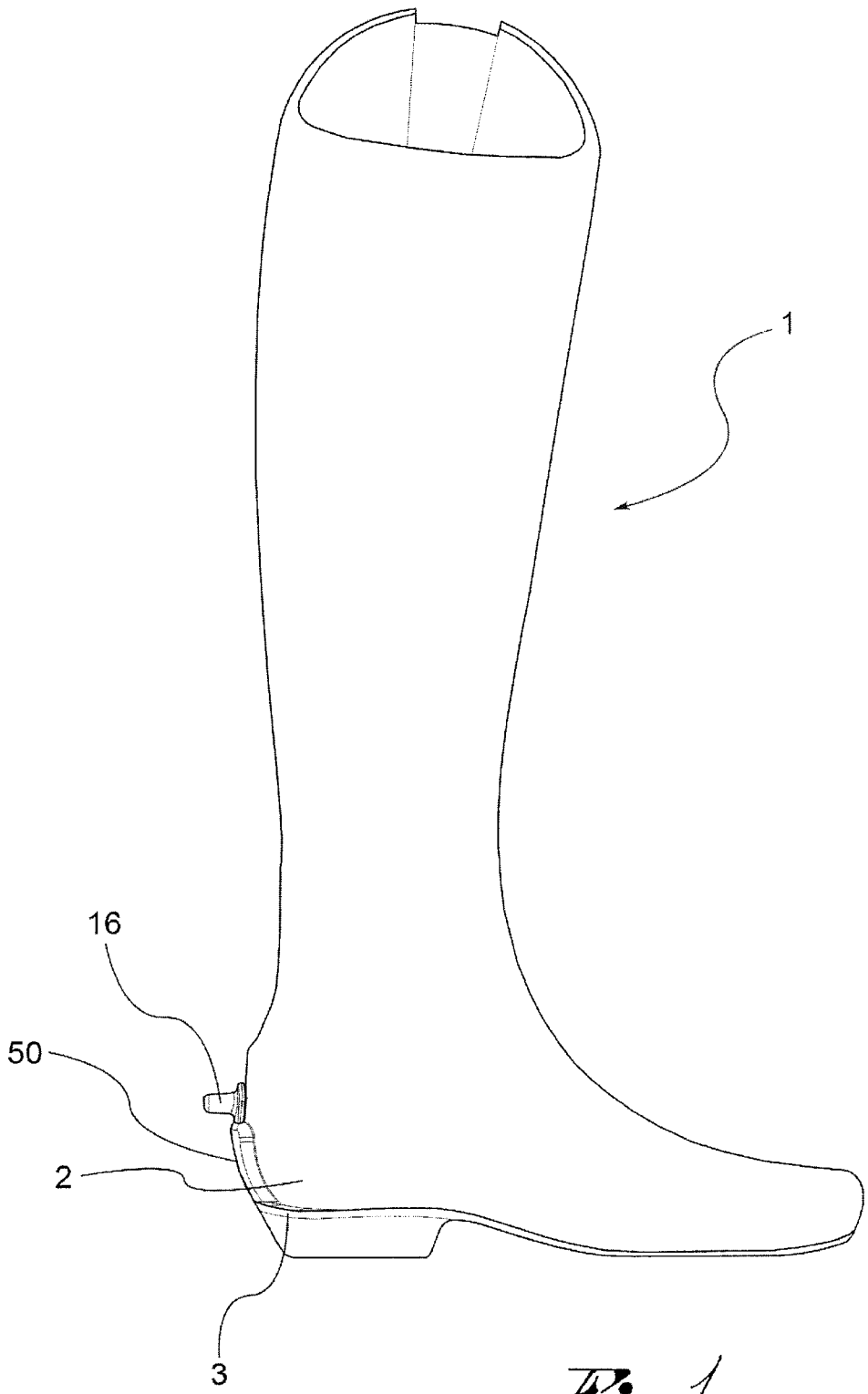
FIG. 1 illustrates, in side view, a horse-riding boot according to the invention in a first embodiment.
Figure 2:
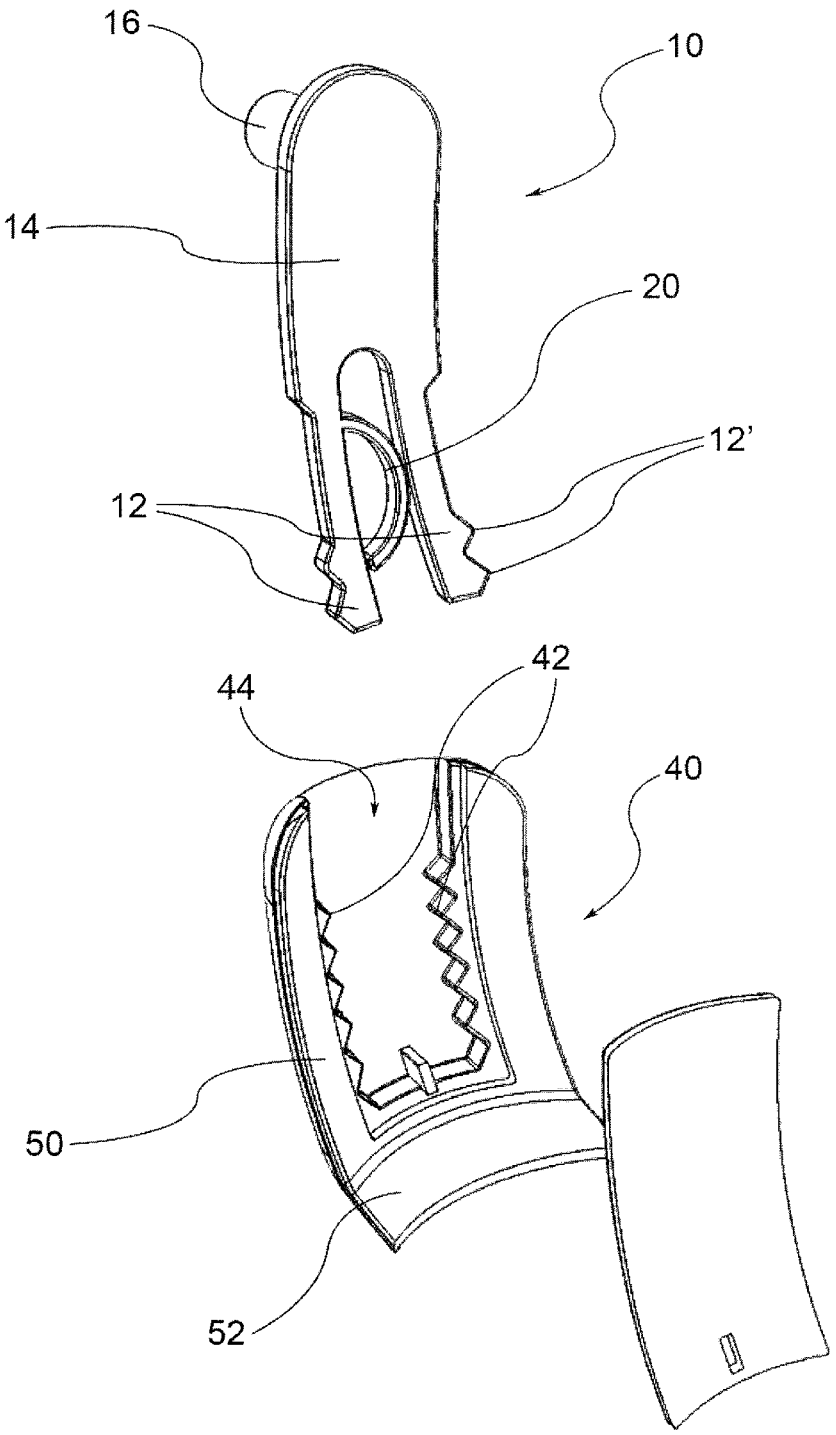
FIG. 2 is an exploded perspective view of the spur alone and of the relative spur-holder seat.
Figure 3:
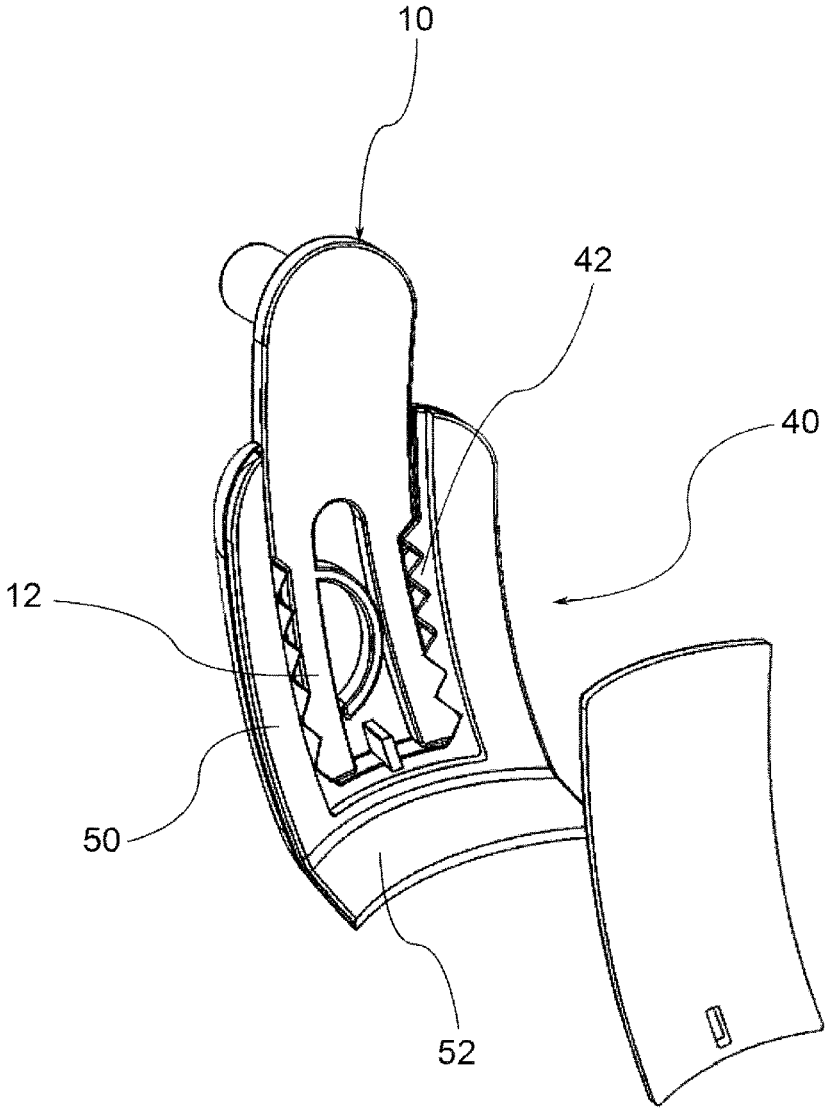
FIG. 3 shows the spur inserted in the respective spur-holder seat.
Figure 5:
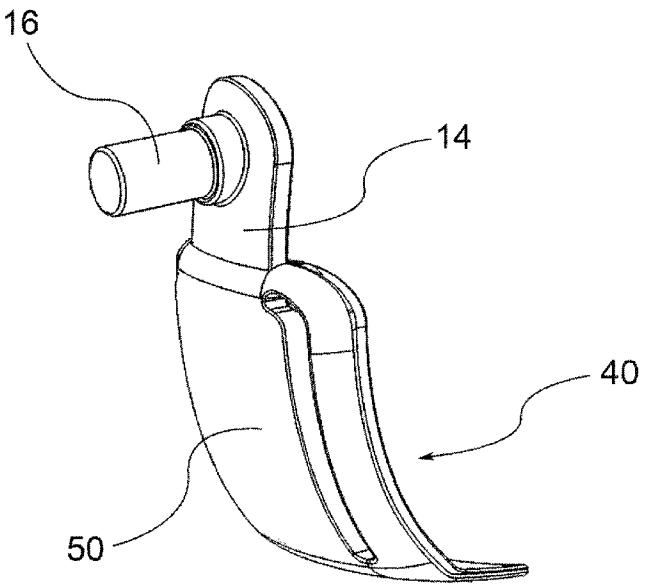
FIGS. 4 and 5 show perspective views from behind of the spur separated from and inserted in the corresponding seat, respectively.
Figure 4:
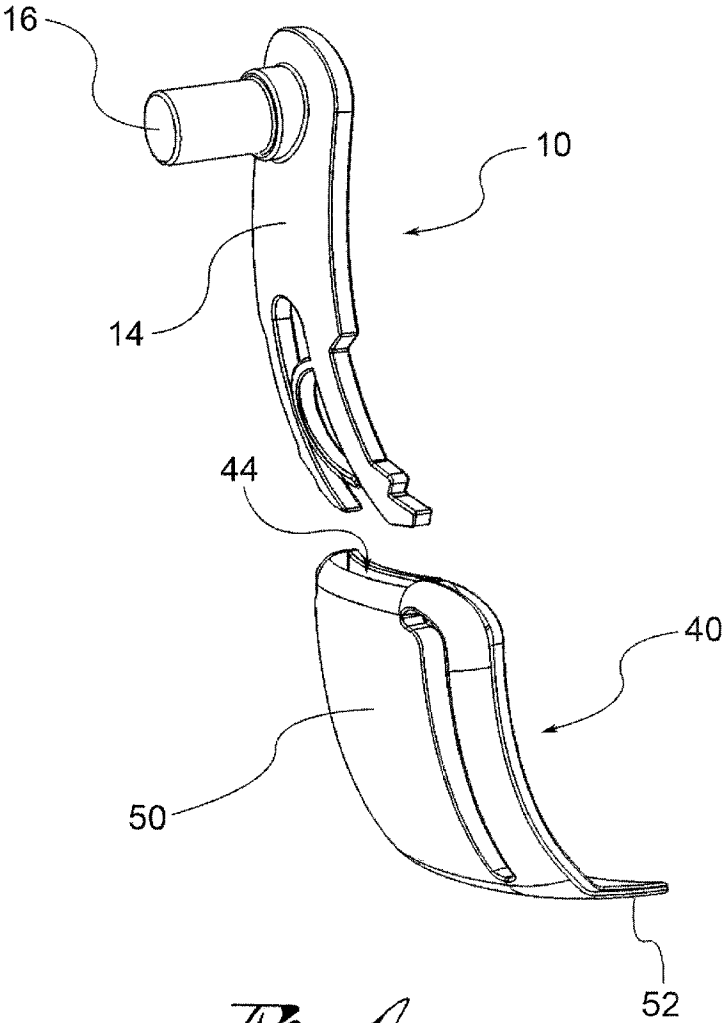
Figure 6:
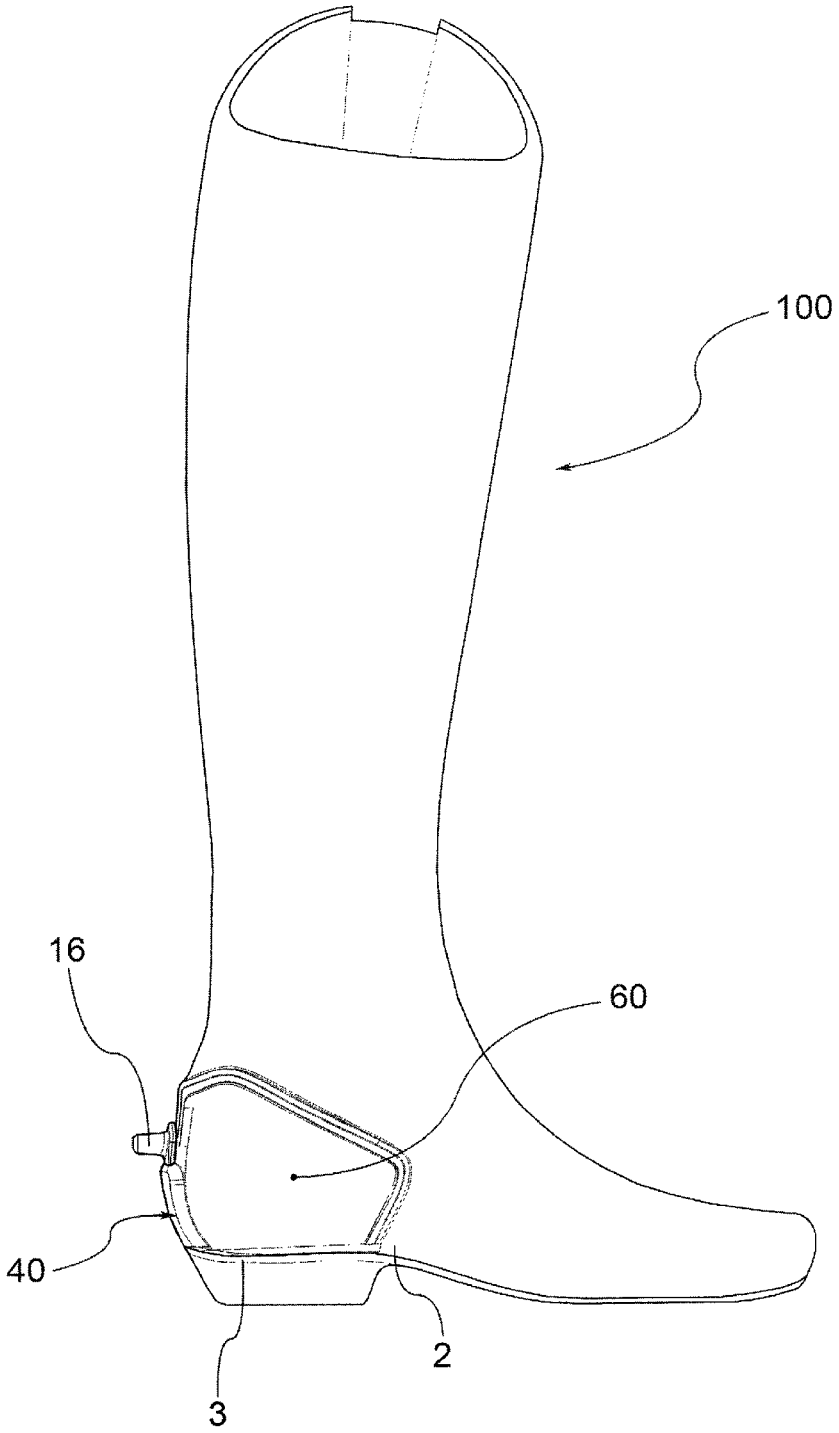
FIG. 6 illustrates, in side view, a horse-riding boot according to the invention in a second embodiment.
Figure 7:
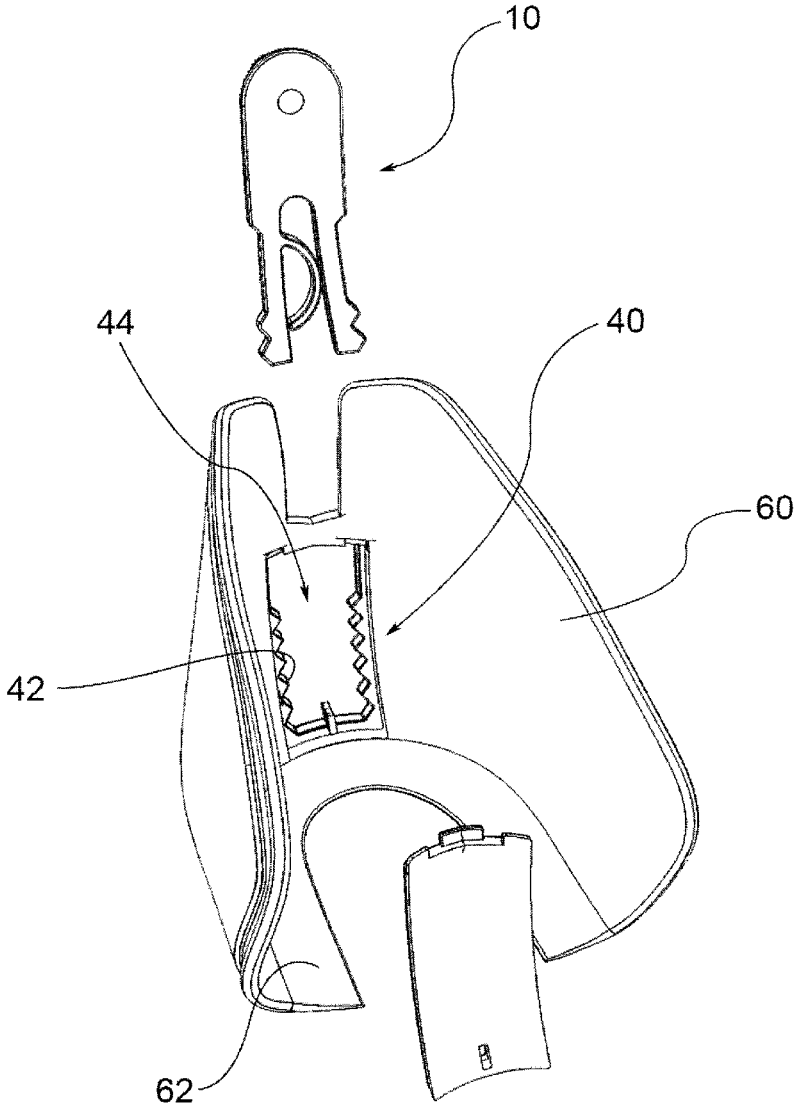
FIG. 7 is an exploded perspective view of the spur alone and of the relative spur-holder seat for the boot in FIG. 6.
Figure 8:
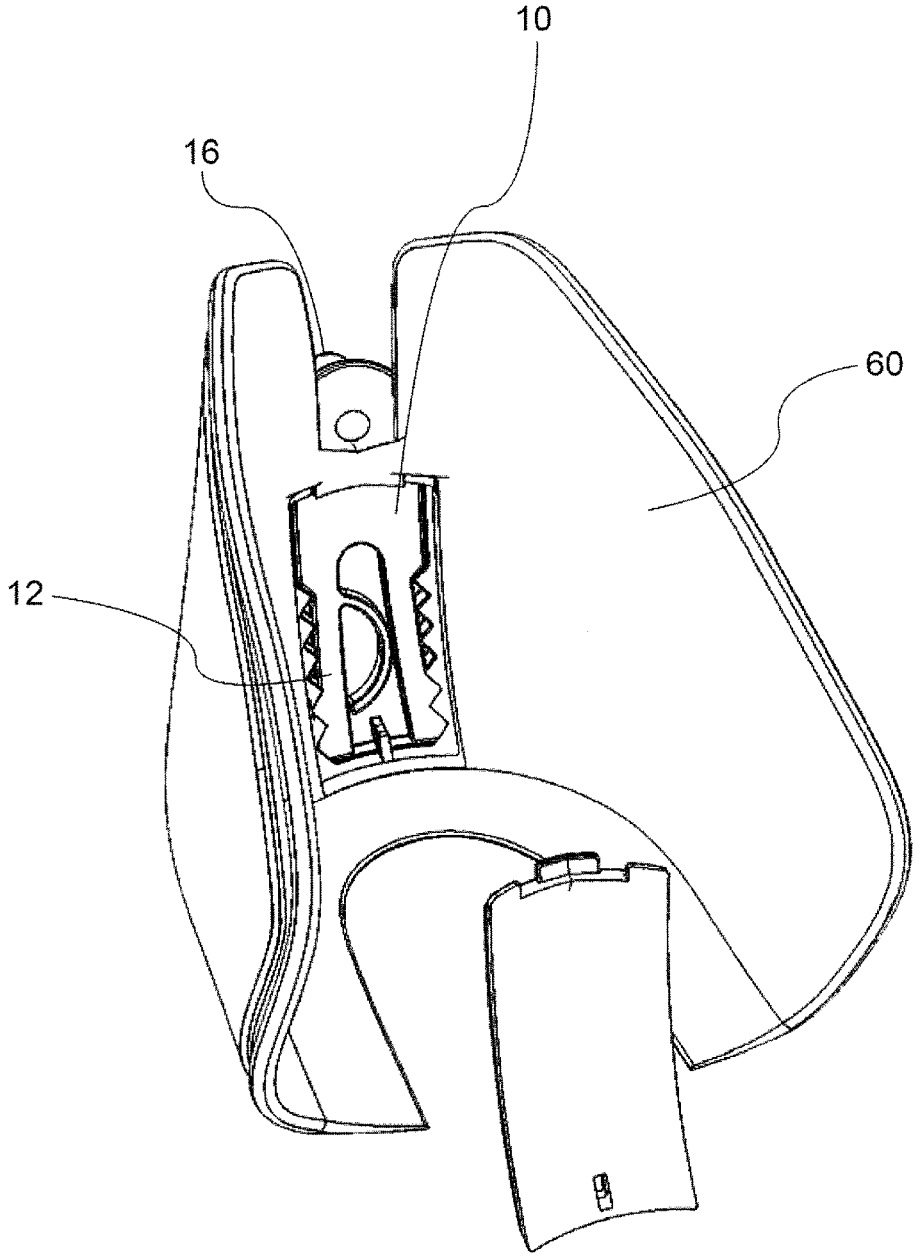
FIG. 8 shows the spur inserted in the respective spur-holder seat.
Figure 10:
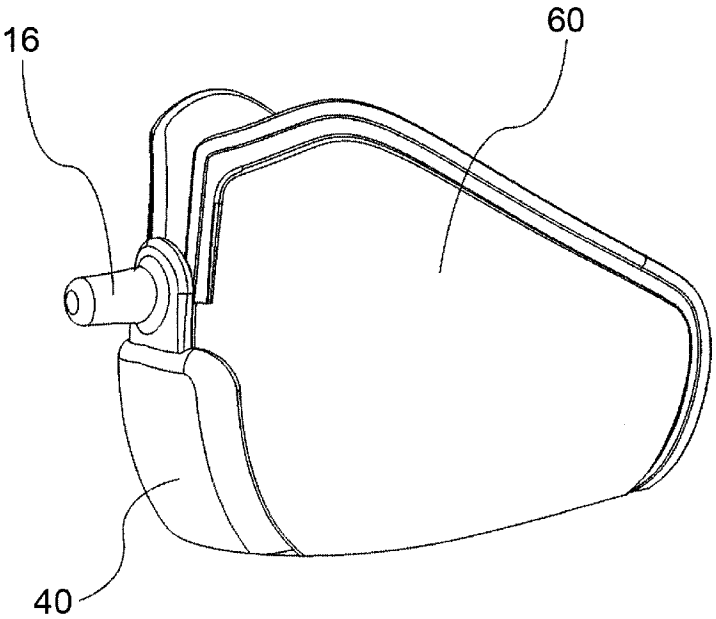
FIGS. 9 and 10 show perspective views from behind of the spur separated from and inserted in the corresponding seat, respectively for the boot in FIG. 6.
Figure 9:
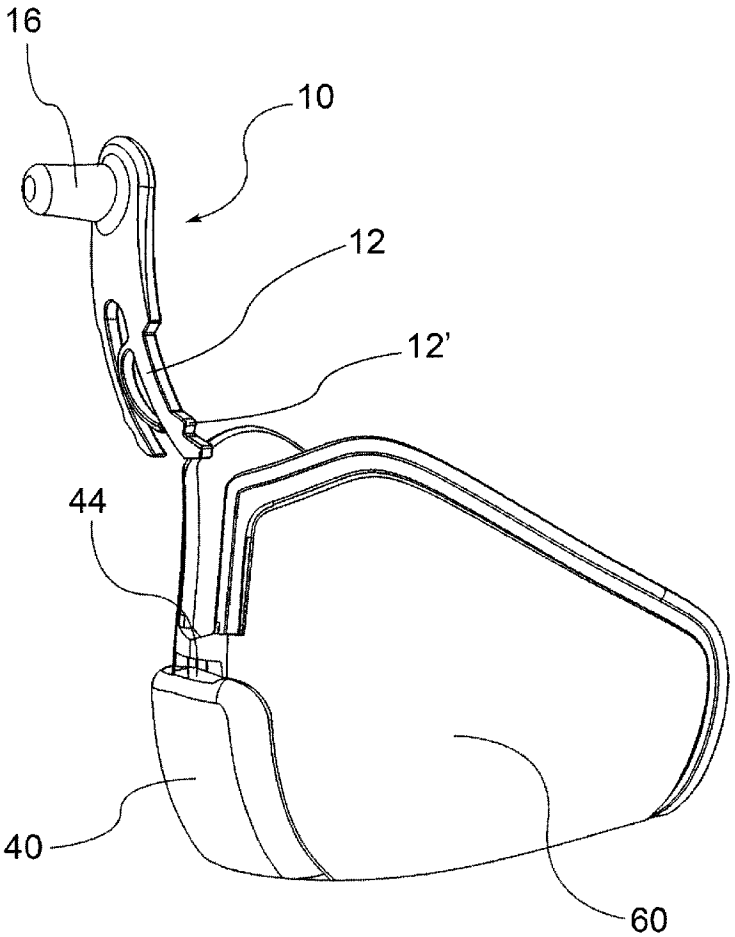

In said drawings, reference numerals 1; 100 globally denote horse-riding boot according to the invention.

In a general embodiment, the boot 1; 100 comprises a spur 10 and a spur-holder seat 40 associated to the boot 1; 100. The spur-holder seat 40 is positioned at the rear of the boot at the heel. In particular, the spur-holder seat 40 is confined to the rear of the boot only, i.e. is free of the portions which also extend around the sides of the boot.

The spur 10 and the spur-holder seat 40 are connected together in a detachable manner. In other words, the spur 10 can be removed from the relative seat 40, leaving the spur-holder seat 40 attached to the boot.

The boot 1; 100 further comprises elements for adjusting in height the position of the spur 10. Henceforth in the description, adjustment in height of the position of the spur 10 is understood to mean in relation to the spur-holder seat 40 which the spur 10 is at least partially inserted in and in the direction perpendicular to the ground when the boot is on the ground.

In a preferred embodiment, said adjustment elements in height are made in the connection elements 12, 42 which permit the detachable connection of the spur 10 to the spur-holder seat 40.

In a preferred embodiment, the spur-holder seat 40 is delimited by at least one toothed rim 42. The spur 10 is provided with at least one toothed arm 10 suitable to engage in said toothed rim 42.

More specifically, in a preferred embodiment the spur-holder seat 40 includes a pocket 44 having a pair of toothed longitudinal rims 42, substantially parallel to each other. Longitudinal rims are taken to mean rims which extend in a direction parallel to the substantially vertical axis of the boot, i.e. perpendicular to the ground.

The spur 10 is provided with a pair of toothed arms 12 suitable to be inserted in said pocket 44 to engage in the respective toothed rims 42. For example, each toothed arm 12 terminates with a pair of teeth 12'. The profile of the indentation of the toothed rims 42 and of the teeth 12' of the toothed arms 12 is such as to permit a sliding of the toothed arms 12 along the indentation of the toothed rims when the spur 10 is subjected to a force acting in the longitudinal direction.

When such force ceases, the spur remains attached to its seat in the desired position, or at the desired height in relation to the boot.

Figure 11:
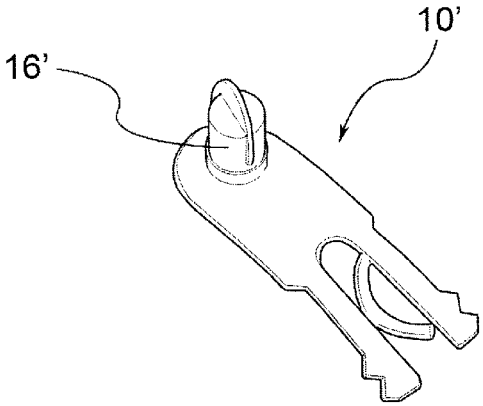
FIG. 11 shows another example of a spur insertable in the spur-holder seat.

In one embodiment, the toothed arms 12 extend from a spur plate 14 from which at least a tip of the spur 16 emerges, for example a cylindrical, conical, truncated-cone, spherical or any other shape of protuberance suitable to come into contact with the flank of the horse. FIG. 11 shows an example of a spur 10' having a different spur tip 16'.

In addition, in one embodiment, the toothed arms 12 are elastic arms or elastically influenced arms so as to be normally kept in an expanded position of engagement with the respective toothed rims 42 and to flex towards each other as they slide along the toothed rims 42. For example, the toothed arms 42 are connected to each other by elastic contrast elements 20 suitable to keep said arms in the expanded engagement position.

In one embodiment, the pocket 44 is open at the top for insertion from above of the spur 10. For example, said pocket 44 is closed on all other sides so as to protect the connection elements of the spur 10 to the relative spur-holder seat 40 from dirt and atmospheric agents.

Clearly, even when the spur 10 is in the lower position the tip of the spur 16 protrudes upward from the pocket.

In one embodiment illustrated in FIGS. 1-5, the spur-holder seat 40, and in particular the pocket 44, is made in a plate-like spur-holder seat body 50 made separately from the boot 1 and attached to a rear portion of the boot.

For example, said spur-holder seat body 50 is provided with an attachment tab 52 to the boot 1 inserted and retained between the upper 2 and the sole 3 of the boot 1.

In an embodiment variant illustrated in FIGS. 6-10, the spur-holder seat 40, and in particular the pocket 44, are made in an heel-cover element 60 which surrounds the heel part of the boot 100, partially embracing also the sides 100 of the boot. In this case too, the spur-holder seat 40 is positioned at the rear side of the boot.

For example, said heel-cover element 60 is provided with an inner rim 62 fastening to the boot, inserted and retained between the upper and the sole of the boot 100.

In one advantageous embodiment, the spur-holder body 50 or said heel-cover element 60 are made of a plastic material, for example by moulding.

Figure 12:
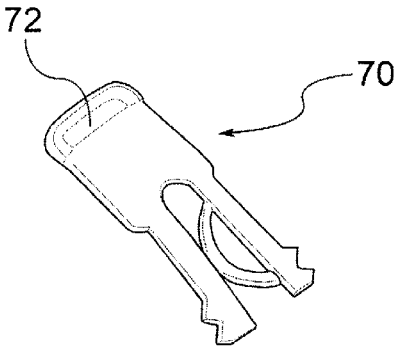
FIG. 12 is a mock spur to be inserted into the spur-holder seat.

FIG. 12 shows an example of mock spur 70 used as a stopper to close the spur-holder seat 40 when the boot 1; 100 is worn for normal use on the ground, to prevent dirt from getting into the pocket 44. Advantageously, the mock spur 70 has the same structure as the spur 10, except for the fact that in place of the tip of the spur 16 there is a slot 72 or other equivalent mechanism for gripping suitable to permit easy extraction of the mock spur 70 from the spur-holder seat 40.

Figure 13:
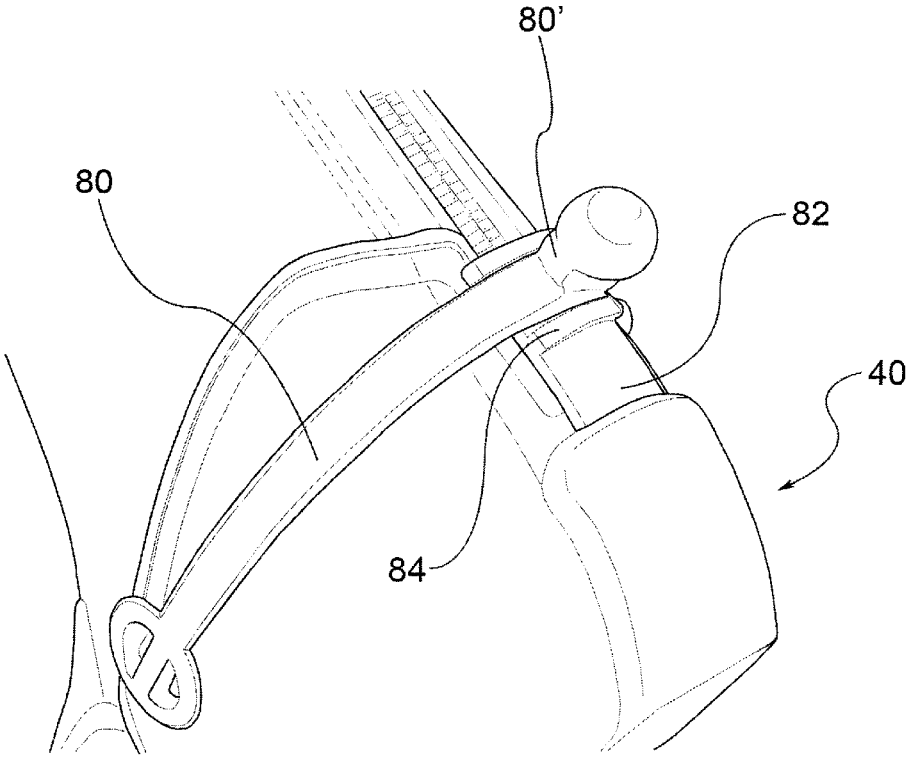
FIG. 13 shows the rear part of a boot according to a further embodiment.

FIG. 13 shows a further application of the teaching of the present invention. Here a traditional spur 80 having the classic "U" shape is used in combination with the spur-holder seat 40 and with a slider 82 inserted in said spur-holder seat 40 and adjustable in height in relation to said seat. Advantageously, said slider 82 has the same structure as the spur 10 previously described, where, in place of the tip of the spur 16 a guide 84 is made suitable to engage the rear end 80' of the traditional spur 80 so as to permit a height adjustment of said rear end 80'.

It is clear that the spur of the boot according to the invention does not in any way damage the upper or the zip of the boot, as it engages in a respective seat confined in the back part of the boot and made in a cover body or cover integral with boot itself.

Advantageously, said cover body or element of the heel of the boot, once attached to the boot, forms an integral part thereof. Said spur-holder elements being made so as to fit perfectly to the boot, they lend the boot an appreciable aesthetic effect and the boot may thus be used even without the spur, preferably by closing the spur-holder seat with the mock-spur described above.

Through a simple action of pushing or pulling the spur, the position in height of the latter can be easily and quickly adjusted.

In addition, the easy removal of the spur 10 from the respective seat 40 makes it possible to rapidly replace one spur with another, for example having a different tip.

A person skilled in the art may make modifications and adaptations to embodiments of riding boots according to the invention, replacing elements with others functionally equivalent so as to satisfy contingent requirements while remaining within the scope of protection claimed herein.

For example, options for adjusting the position of the spur could be a different shape from that described, and need not necessarily be made in the coupling elements of the spur to the spur-holder seat. For example, said adjustment elements could be of the type comprising a screw or a clamp which blocks a portion of the sliding spur in the respective seat at the desired height.

Each of the characteristics described as belonging to a possible embodiment may be realised independently of the other embodiments described.

The invention claimed is:

1. A riding boot, comprising a spur and a spur-holder seat joined to the boot, said spur comprising a portion suitable for being slidably inserted in said spur-holder seat, and adjustment elements for adjusting the position of the spur, wherein said spur-holder seat is delimited by at least one toothed rim, wherein the spur is provided with at least one toothed arm suitable for engaging in said toothed rim, wherein each toothed arm is slidable along the respective toothed rim when subjected to a force acting in a longitudinal direction, wherein the spur-holder seat comprises a pocket having a pair of toothed longitudinal rims, wherein the spur is provided with a pair of toothed arms suitable for being inserted in said pocket to engage in the respective toothed rims, and wherein said toothed arms are elastic or are connected to each other by elastic contrast elements so as to be kept normally in a divaricated engagement position with the respective toothed rims and to flex towards each other as they slide along the toothed longitudinal rims, the profile of the indentation of the toothed rims and of the teeth of the toothed arms being such as to permit a sliding of the toothed arms along the indentation of the toothed rims when the spur is subjected to a pushing or pulling force acting in the longitudinal direction for adjusting the position in height of the spur, the spur remaining attached to its seat with the toothed arms in the divaricated engagement position at the desired height in relation to the boot when said pushing or pulling force ceases.

2. The boot of claim 1, wherein said spur-holder is confined to the rear side of the boot, so as to leave the sides of the boot free.

3. The boot of claim 1, wherein said toothed arms extend from a spur plate from which at least a tip of the spur emerges.

4. The boot of claim 1, wherein said toothed arms are elastic or are connected to each other by elastic contrast elements so as to be kept normally in a divaricated engagement position with the respective toothed rims.

5. The boot of claim 1, wherein said pocket is open at the top.

6. The boot of claim 1, wherein said spur-holder seat is formed in a plate-shaped spur-holder body made separately from the boot and attached to a rear portion of the boot.

7. The boot of claim 1, wherein said spur-holder seat is made in a heel-cover element which encloses the heel part of the boot.

8. The boot of claim 6, wherein said spur-holder body or said heel-cover element are respectively provided with an attachment tongue to the boot or an inner attachment rim to the boot inserted and retained between the upper and the sole of the boot.

* * * * *